US011629829B2

(12) United States Patent
Klus

(10) Patent No.: US 11,629,829 B2
(45) Date of Patent: Apr. 18, 2023

(54) SURFACE MOUNTED LED-BASED LINEAR LIGHTING APPARATUS WITH ARTICULATING FASTENER

(71) Applicant: KLUS, LLC, Vero Beach, FL (US)

(72) Inventor: Sylwester Klus, Kamionka (PL)

(73) Assignee: KLUS, LLC, Vero Beach, FL (US)

( * ) Notice: Subject to any disclaimer, the term of this patent is extended or adjusted under 35 U.S.C. 154(b) by 27 days.

(21) Appl. No.: 17/334,247

(22) Filed: May 28, 2021

(65) Prior Publication Data

US 2022/0049824 A1 Feb. 17, 2022

(51) Int. Cl.

| | |
|---|---|
| ***F21S 8/00*** | (2006.01) |
| ***F21S 4/28*** | (2016.01) |
| ***F21V 21/30*** | (2006.01) |
| ***F21Y 115/10*** | (2016.01) |
| ***F21Y 103/10*** | (2016.01) |

(52) U.S. Cl.

CPC ..... *F21S 8/036* (2013.01); *F21S 4/28* (2016.01); *F21V 21/30* (2013.01); *F21Y 2103/10* (2016.08); *F21Y 2115/10* (2016.08)

(58) Field of Classification Search

CPC ... F21S 8/036; F21S 4/28; F21V 21/30; F21L 4/04

See application file for complete search history.

(56) References Cited

U.S. PATENT DOCUMENTS

| | | | | |
|---|---|---|---|---|
| 8,764,220 | B2 * | 7/2014 | Chan | F21S 4/28 362/217.02 |
| 2010/0328945 | A1 * | 12/2010 | Song | F21V 29/75 362/240 |
| 2011/0002120 | A1 * | 1/2011 | Song | F21V 29/89 362/249.02 |
| 2017/0370537 | A1 * | 12/2017 | Wu | F21V 17/02 |
| 2020/0132284 | A1 * | 4/2020 | Johnson | F21V 29/745 |

* cited by examiner

*Primary Examiner* — William N Harris
(74) *Attorney, Agent, or Firm* — Mark Terry

(57) ABSTRACT

A surface-mounted linear lighting system includes a metal extrusion having an elongated element having a substantially U-shaped cross-section comprising a first vertical sidewall, a second vertical sidewall and a horizontal floor joining the first and second sidewalls, a first groove on an exterior of the first vertical sidewall, a second groove on an exterior of the horizontal floor, a third groove on the exterior of the horizontal floor, and a fourth groove on an exterior of the second vertical sidewall; and a plurality of articulating fasteners configured for coupling to a pair of grooves in the metal extrusion selected from the group: the first groove, the second groove, the third groove and the fourth groove, fastening to a surface, and providing a hinged connection between the metal extrusion and the surface.

17 Claims, 7 Drawing Sheets

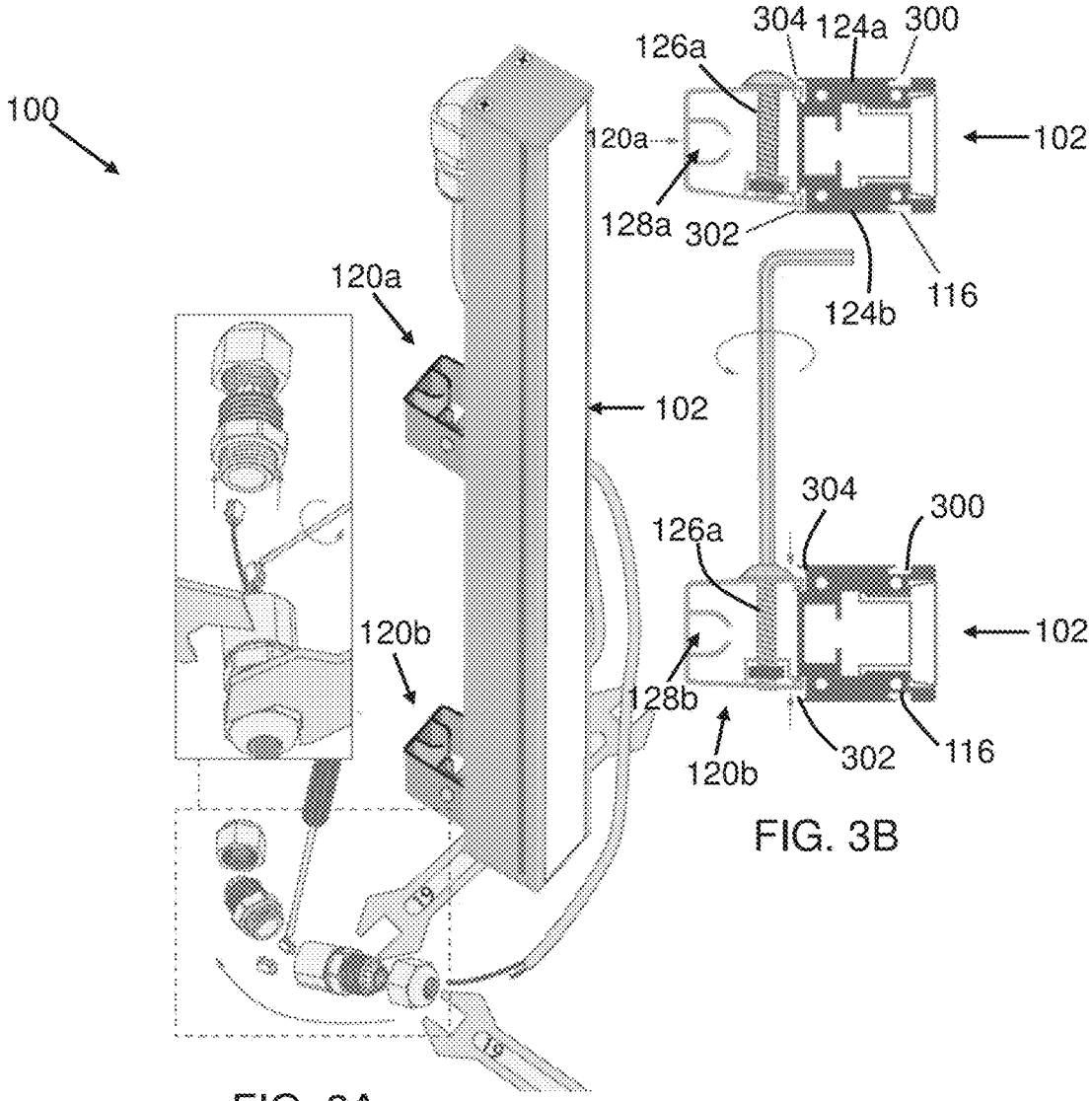
FIG. 3B
FIG. 3A
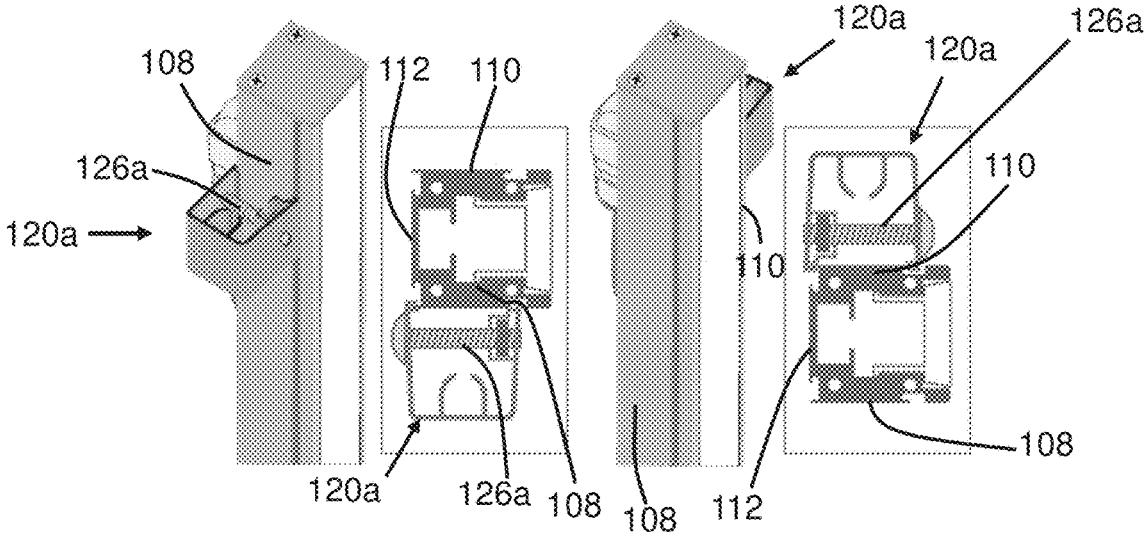
FIG. 3C
FIG. 3D

SURFACE MOUNTED LED-BASED LINEAR LIGHTING APPARATUS WITH ARTICULATING FASTENER

CROSS-REFERENCE TO RELATED APPLICATIONS

This patent application claims priority to European Union Intellectual Property Office (EUIPO) patent application number 008123244-0010 filed on Aug. 17, 2020. This patent application also claims priority to EUIPO patent application number 008123244-0015 filed on Aug. 17, 2020. The subject matter of EUIPO patent applications 008123244-0010 and 008123244-0015 are hereby incorporated by reference in their entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

This invention relates to the field of lighting, and more particularly to the field of LED-based special-purpose lighting.

BACKGROUND OF THE INVENTION

Various types of linear lighting apparatuses exist in the lighting industry today. Many of the latest lighting apparatuses use-light-emitting diodes ("LEDs") as light sources. LEDs are individual point light sources that deliver a singular beam of light. Conventional linear lighting apparatuses that use LEDs are usually constructed for particular purposes. For example, the lighting apparatuses may be constructed for use on ceilings for lighting a room, for use within cabinets to illuminate the contents of a drawer or for use on an exterior wall for lighting a sign.

U.S. Pat. No. 6,361,186, for example, discloses a linear lighting apparatus using LEDs wherein the lighting apparatus is constructed generally for use on walls as commercial signage. U.S. Pat. No. 6,682,205 also discloses an LED-based linear lighting apparatus constructed generally for use on walls as signage. U.S. Pat. No. 6,585,393 discloses an LED linear lighting apparatus constructed generally for use as under-cabinet lighting for the home. Lastly, U.S. Pat. Pub. No. 2006/0146531 discloses a linear lighting apparatus using LEDs wherein the lighting apparatus is constructed generally for lighting billboards or the façade of a building.

One of the problems with currently available linear lighting apparatuses that use LEDs is the limitation on the direction in which the lighting apparatus transmits light. As explained above, most LED-based linear lighting apparatuses are built to illuminate areas of a home or building, portions of furniture such as cabinetry or simply a commercial advertisement. As such, conventional linear lighting apparatuses that use LEDs are set up to illuminate in the top-down direction or the side-to-side direction. In some cases, conventional linear lighting apparatuses that use LEDs are set up to illuminate in a set direction, such as at a 45 degree angle. No such LED-based linear lighting apparatuses, however, are available for lighting in a direction that is adjustable. This is disadvantageous since there is a need to light areas in such a way that the direction of illumination may be changed or adjusted.

Therefore, there is a need to traverse the deficiencies in the art and more particularly there is a need for a more versatile LED-based linear lighting apparatus wherein the direction of illumination may be changed or adjusted.

SUMMARY OF THE INVENTION

Briefly, in accordance with one embodiment, a surface-mounted linear lighting system is disclosed. The system includes a metal extrusion comprising: a) an elongated element having a substantially U-shaped cross-section comprising a first vertical sidewall, a second vertical sidewall and a horizontal floor joining the first and second sidewalls, b) a first groove on an exterior of the first vertical sidewall, c) a second groove on an exterior of the horizontal floor, d) a third groove on the exterior of the horizontal floor, and e) a fourth groove on an exterior of the second vertical sidewall; and a plurality of articulating fasteners configured for: a) coupling to a pair of grooves in the metal extrusion selected from the group: the first groove, the second groove, the third groove and the fourth groove, b) fastening to a surface, and b) providing a hinged connection between the metal extrusion and the surface.

In another embodiment, the system includes a metal extrusion comprising: a) an elongated element having a substantially U-shaped cross-section comprising a first vertical sidewall, a second vertical sidewall and a horizontal floor joining the first and second sidewalls, b) a first groove on an exterior of the first vertical sidewall, c) a second groove on an exterior of the horizontal floor, d) a third groove on the exterior of the horizontal floor, and e) a fourth groove on an exterior of the second vertical sidewall; and a plurality of articulating fasteners configured for providing a hinged connection between the metal extrusion and a surface, wherein each of the plurality of articulating fasteners comprises: a) a tightening element having a substantially U-shaped cross-section wherein the tightening element is configured for coupling to a pair of grooves in the metal extrusion selected from the group: the first groove, the second groove, the third groove and the fourth groove; and b) a surface bracket having a substantially U-shaped cross-section wherein the surface bracket is configured for fastening to the surface, and hingedly coupling to the tightening element.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

FIGS. 3A-3D show perspective views of the surface mounted LED-based linear lighting system with articulating fastener, in a semi-assembled state, in accordance with one embodiment.

DETAILED DESCRIPTION

Figure 1:
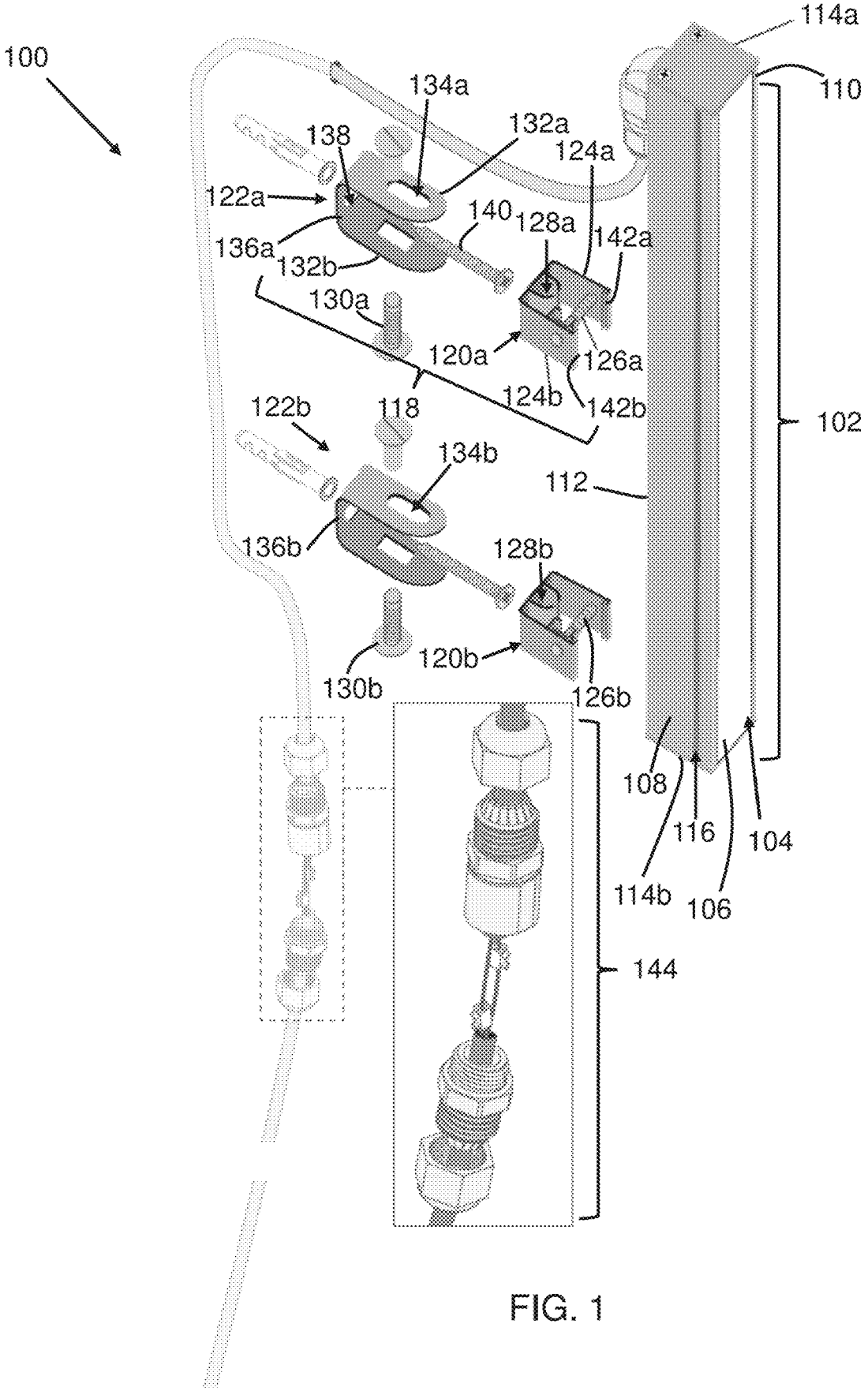
FIG. 1 shows a perspective view of a surface mounted LED-based linear lighting system with articulating fastener, in a disassembled state, in accordance with one embodiment.

It should be understood that these embodiments are only examples of the many advantageous uses of the innovative teachings herein. In general, statements made in the specification of the present application do not necessarily limit any of the various claimed embodiments. Moreover, some statements may apply to some inventive features but not to others. In general, unless otherwise indicated, singular elements may be in the plural and vice versa with no loss of generality. In the drawing like numerals refer to like parts through several views.

The claimed embodiments, according to a preferred embodiment, overcomes problems with the prior art by providing a special purpose surface-mounted linear lighting system, wherein the direction of illumination may be changed or adjusted. This is advantageous as it increases the range of places where the lighting system of the can be used. Also, the claimed embodiments can illuminate outdoor areas, indoor living spaces, cabinets, shelves, closets, small areas, the floor and ground areas from any surface to which the surface-mounted linear lighting system is mounted. Furthermore, the construction of the claimed embodiments withstands wind, heavy loads and robust strikes or jolts so that the surface-mounted linear lighting system can safely be located in places with high traffic. This is advantageous as it allows for the illumination of heavy-traffic areas, with the flexibility that the direction of illumination may be changed or adjusted.

Additionally, the special purpose surface-mounted linear lighting system of the claimed embodiments is constructed so as to allow the lighting apparatus to be mounted to any surface, such as walls, floors, ceilings, concrete, grout, or another setting material during or after construction of a building or a ground area. Lastly, the claimed embodiments include a removable outward face that allows for quick and easy access to the inner working of the lighting apparatus in the event the device requires replacement or repair.

The claimed embodiments provide a linear lighting configuration that utilizes LEDs with the intended function of special purpose lighting for outdoor areas, indoor living spaces, cabinets, shelves, closets, small areas, the floor, and ground areas. The claimed embodiments may be used as a low voltage linear light luminaire for both indoor and outdoor applications. The claimed embodiments exude light from LEDs in an adjustable direction to illuminate areas from a variety of directions. The claimed embodiments are constructed for placement into on walls, ceilings, floors, etc. The articulating fastener provides stability, withstanding wind, heavy loads, strikes/blows. Further, the placement of the special purpose surface-mounted linear lighting system in certain high traffic and high impact areas requires that it withstands heavy loads and robust strikes or jolts.

The claimed embodiments comprise an elongated unit of material having a substantially U-shaped cross-section. The elongated unit may comprise any of a variety of materials, including aluminum, various alloys, ceramic or plastic. Further, the elongated unit may be fabricated using any of a variety of processes, such as extrusion, injection molding, or metal working. In a preferred embodiment, the elongated unit comprises extruded aluminum. The elongated unit may be fabricated in a variety of predefined lengths, such as one-meter lengths. In addition, the elongated unit may be customizable in length.

Looking initially at FIG. 1, the surface-mounted linear lighting system 100 comprises a metal extrusion 102 that carries a lighting means, such as an LED, and is mountable in a manner that enables the direction of illumination to be pivotally adjusted, such that the illumination is directed towards a desired direction. In one embodiment, the extrusion 102 comprises an elongated element having a substantially U-shaped cross-section. The elongated configuration is sized and dimensioned to accommodate longer LEDs 106, as are known in the art.

As FIG. 3A shows, the U-shaped cross-section is made up of three walls, including a first vertical sidewall 108, a second vertical sidewall 110, and a horizontal floor 112. The sidewalls 108, 110 and the horizontal wall join at the edges to create the U-shape. In one embodiment, the first and second vertical sidewalls 108, 110 form a parallel, spaced-apart relationship. The edges of the horizontal floor 112 form an orthogonal with the edges of the first and second sidewalls 108, 110, so as to configure the shape and dimensions of the extrusion 102. However, it is significant to note that in alternative embodiments, the extrusion 102 may also form V-shape or a C-shape, or any general concave shape adapted to receive an LED 106.

In one possible embodiment, the elongated shape, and U-shaped configuration of the extrusion 102 define a concave channel 104 that is sized and dimensioned to securely retain LED 106 (See FIG. 3B). It is known in the art that such an LED 106 can be an individual point light source that delivers a singular beam of light. Thus, from within the channel 104, the LED 106 emits illumination for enhanced viewing. In some embodiments, a top cap 114*a* engages the top ends of the sidewalls 108, 110 in a flush relationship. A bottom cap 114*b* engages the bottom ends of the sidewalls 108, 110 in a flush relationship. The caps 114*a-b* help prevent moisture and contaminants from entering the LED 106.

Figure 4A:
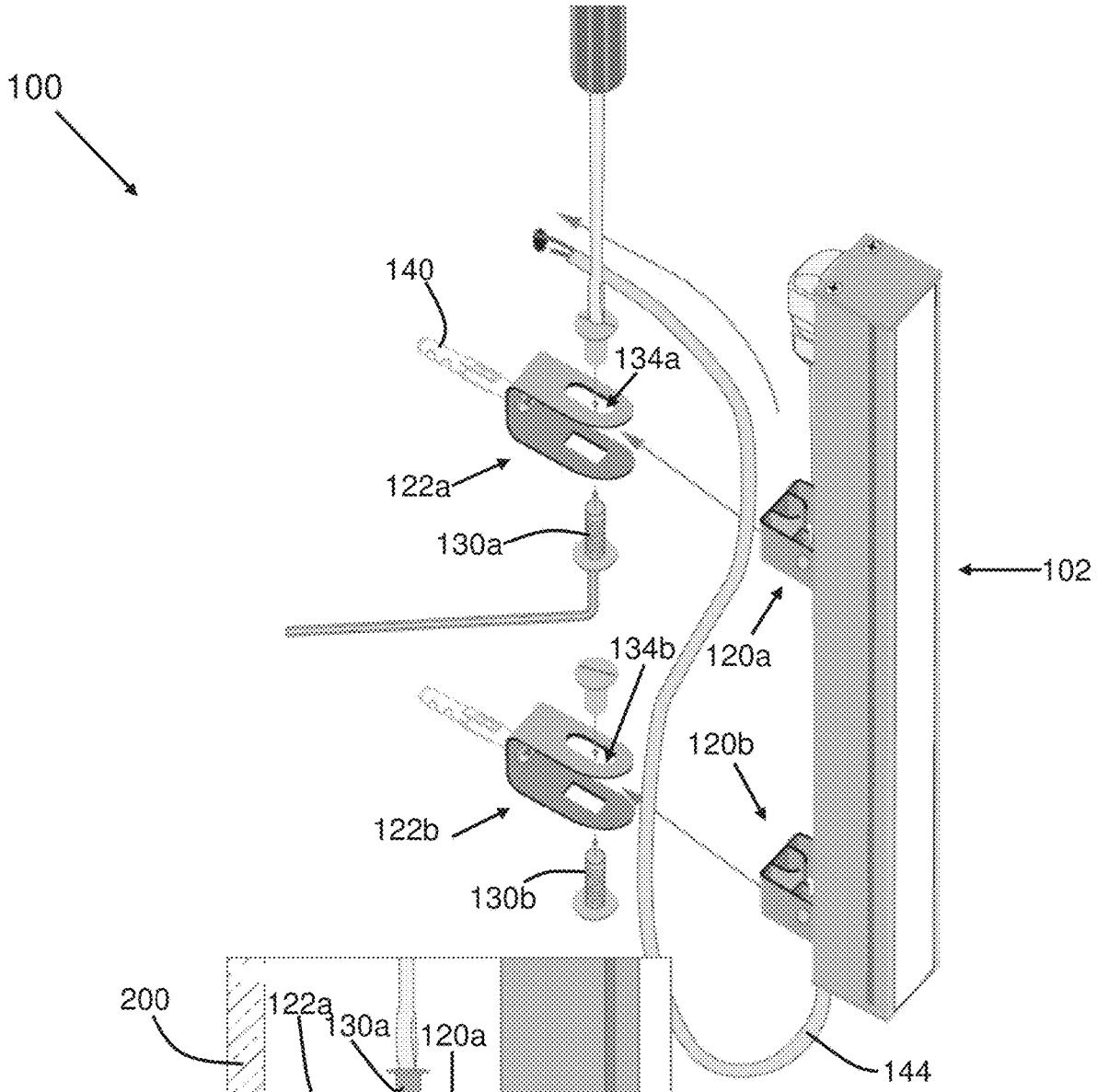
FIGS. 4A-4B show perspective views of the surface mounted LED-based linear lighting system with articulating fastener during assembly, in accordance with one embodiment.

To enable electrical connectivity for powering the LED 106, an external power cord subassembly 144, shown in FIG. 4A couples to an electrical port in the exterior of the horizontal floor 112. The external power cord subassembly 144 may draw electrical power from an external A/C power outlet, as is known in the art.

The first vertical sidewall 108, the second vertical sidewall 110, and the horizontal floor 112 may have a length between 6"-6', and a width between 2"-24". However, the system 100 is scalable, so smaller or larger dimensions of the sidewalls 108, 110 and horizontal floor 112 may also be possible. Suitable materials for sidewalls 108, 110 and the horizontal floor 112 may include, without limitation, aluminum, steel, iron, metal alloys, and a heat resistant polymer. In alternative embodiment, a heat dissipator, or a rubber panel may be used to minimize heat emitting from the contained LED 106.

Figure 4B:
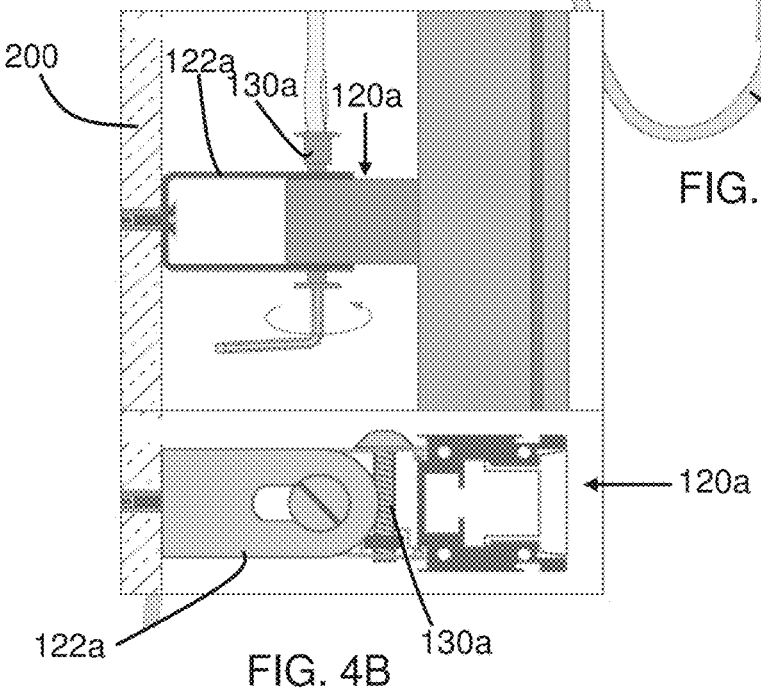

Turning now to FIG. 4B, the exterior surfaces of the sidewalls 108, 110 and the horizontal floor 112 define elongated grooves, which as described below, serve as connection points for mounting the extrusion 102 to a surface. In one possible embodiment, a first groove 116 forms on an exterior of the first vertical sidewall 108. The first groove 116 may be elongated and extend the length of the first vertical sidewall 108. The first groove 116 may have a length between 6"-6' and a depth between 0.5-4 mm. The first groove 116 may be off-center, towards the front of the first vertical sidewall 108. However, in other embodiments, the first groove 116 runs central, and equidistant from both edges of the first vertical sidewall 108.

Similarly, the second vertical sidewall 110 defines a fourth groove 300 on the second vertical sidewall 110. The fourth groove 300 may be elongated and extend the length of the second vertical sidewall 110. The fourth groove 300 may have a length between 6"-6' and a depth between 0.5-4 mm. The fourth groove 300 may be off-center, towards the front of the second vertical sidewall 110. However, in other embodiments, the fourth groove 300 runs central, and equidistant from both edges of the second vertical sidewall 110. However, in other embodiments, the first groove 116 is located at or near a top of the first vertical sidewall 108, and the fourth groove 300 is located at or near a top of the second vertical sidewall 110.

In addition to the sidewalls 108, 110, the horizontal floor 112 also defines a pair of parallel, spaced apart grooves—a second groove 302 and a third groove 304. The second and third grooves 302, 304, similar to the first and fourth groves are elongated, and run the length of the exterior of the horizontal floor 112. In some embodiments, the second groove 302 is located at or near the first vertical sidewall 108. And the third groove 304 is located at or near the second vertical sidewall 110. However, in other embodiments, the second groove 302 and the third groove 304 may run central, and equidistant from both edges of the horizontal floor 112.

The second and third grooves 302, 304 also serve as connection points for mounting the extrusion 102. In one possible embodiment shown in FIG. 3B, the second and third grooves 302, 304 serve as the connection points. In another embodiment shown in FIG. 3C, the second groove 302 of the horizontal wall and the first groove 116 of the first sidewall serve as connection points. In yet another embodiment, the third groove 304 of the horizontal wall and the fourth groove 300 of the second sidewall serve as connection points (See FIG. 3D).

To detachably couple to the grooves, and thereby mount the extrusion 102 to the mounting surface 200, the system 100 comprises a plurality of articulating fasteners 118. The articulating fasteners 118 may include a two-piece fastening component that is both configured to be pivotable, and to couple to at least two of the grooves in the sidewalls 108, 110 and/or horizontal floor 112. This may include coupling to at least one of: the first groove 116, the second groove 302, the third groove 304, and the fourth groove 300. It is significant to note that the use of grooves for coupling leverages the use of efficient geometric interconnections, while also reducing the amount of extrusion 102 material, space, and tools necessary to mount the extrusion 102.

In addition to coupling to the grooves in the extrusion 102, the articulating fastener 118 also fixedly fastens to the mounting surface 200. Thus, the articulating fastener is configured to fasten to a fixed mounting surface 200 from one end, and the extrusion 102 from an opposing end. As FIG. 5B shows, the articulating fastener 118 also pivots in multiple direction up to 360° while mounted in this fashion. In one embodiment, the articulating fastener 118 pivotally articulates, so as to serve as a hinged connection between the extrusion 102 and the mounting surface 200. It is this pivoting articulation that enables the LED 106 in the extrusion 102 to be mountable in a manner that enables the direction of illumination to be changed or adjusted.

In some embodiments, each of the plurality of articulating fasteners 118 comprise a tightening element 120*a-b* and a surface bracket 122*a-b*. The tightening element 120*a-b* is the component that couples to the first and fourth grooves 116, 300 on the sidewalls 108, 110 and the second and third grooves 302, 304 on the horizontal floor 112. The tightening element 120*a*, 120*b* is defined by a substantially U-shaped cross-section. In one non-limiting embodiment, the tightening element 120*a-b* comprises a pair of projecting flanges 124*a*, 124*b* extend at an orthogonal from the U-shaped cross-section, forming free edges 142*a*, 142*b* at the termini.

The position and configuration of the projecting flanges 124*a-b* enables facilitated, yet secure, coupling of the free edges 142*a-b* into the grooves that form in the extrusion 102. In one embodiment, the free edges 142*a-b* of the projecting flanges 124*a-b* are slidably introduced into the grooves from the top end 114*a* of the extrusion 102. Once introduced into the groove, the projecting flanges 124*a-b* restrict disengagement of the tightening element 120*a-b* from the extrusion 102.

In an alternative embodiment, the projecting flanges 124*a-b* are flexible, and form a snap-fit relationship with the grooves. In this arrangement, the extrusion 102 can be pressed into the tightening member, to couple thereto. As discussed above, the flanges can couple to either, the first groove 116, the second groove 302, the third groove 304, the fourth groove 300, or combinations thereof (See FIGS. 3B-3D).

Since the distances between the first, second, third, and fourth grooves vary, it is necessary for the projecting flanges 124*a-b* to be width adjustable. For example, the distance between the second and third grooves 302, 304 on the horizontal floor 112 is less than the distance between the second groove 302 of the horizontal wall and the first groove 116 of the first sidewall.

Thus, the width of the articulating fasteners 118, i.e., distance between projecting flanges 124*a-b*, must be adjustable. To adjust the width, the tightening element 120*a-b* also includes a fastening screw 126*a*, 126*b*. As FIGS. 5C and 5D illustrate, the fastening screw 126*a-b* is configured to adjust the distance between the pair of projecting flanges 124*a-b*. Additionally, the fastening screw 126*a-b* adjusts the coupling between the tightening element 120*a-b* and the pair of grooves being coupled to in the extrusion 102.

Figure 2A:
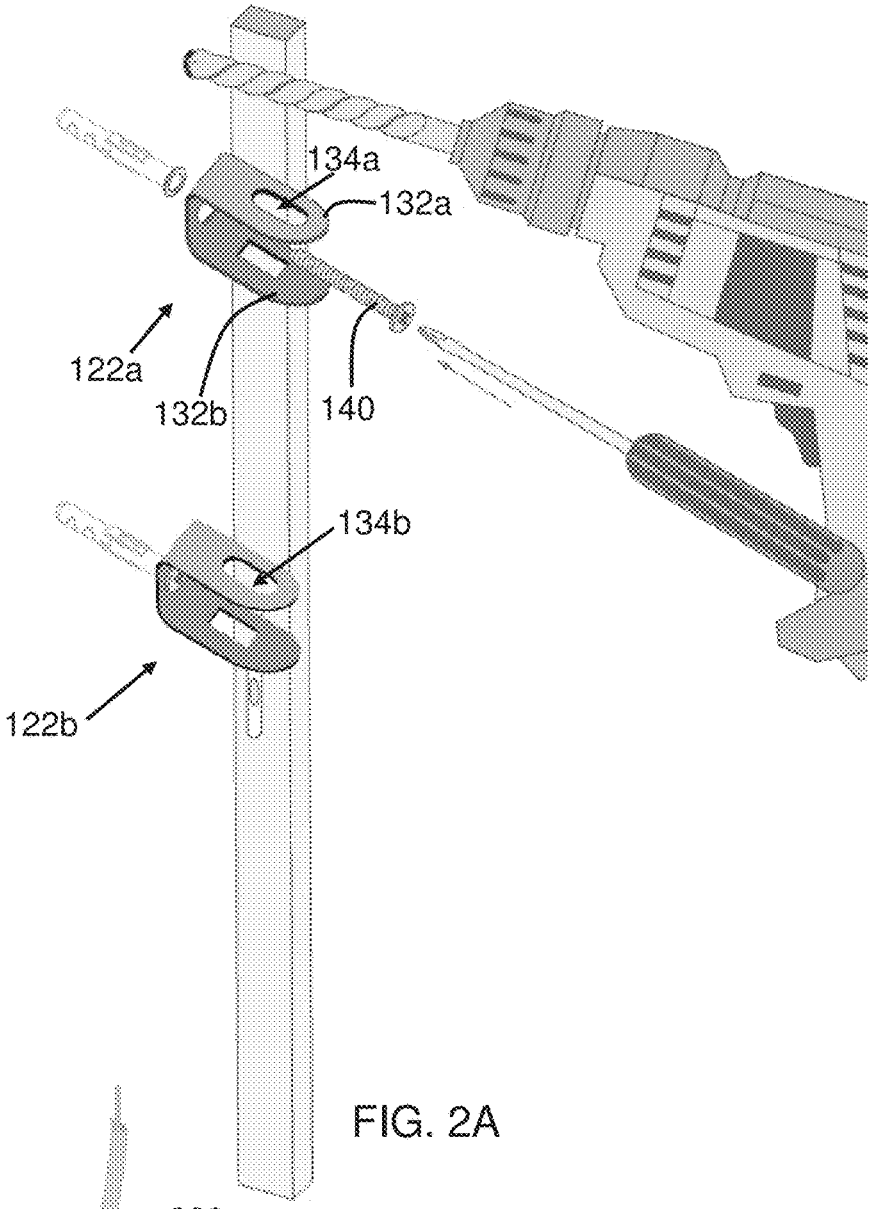
FIGS. 2A-2B show perspective views of a method for attaching the fastener of the surface mounted LED-based linear lighting system with articulating fastener, in accordance with one embodiment.
Figure 2B:
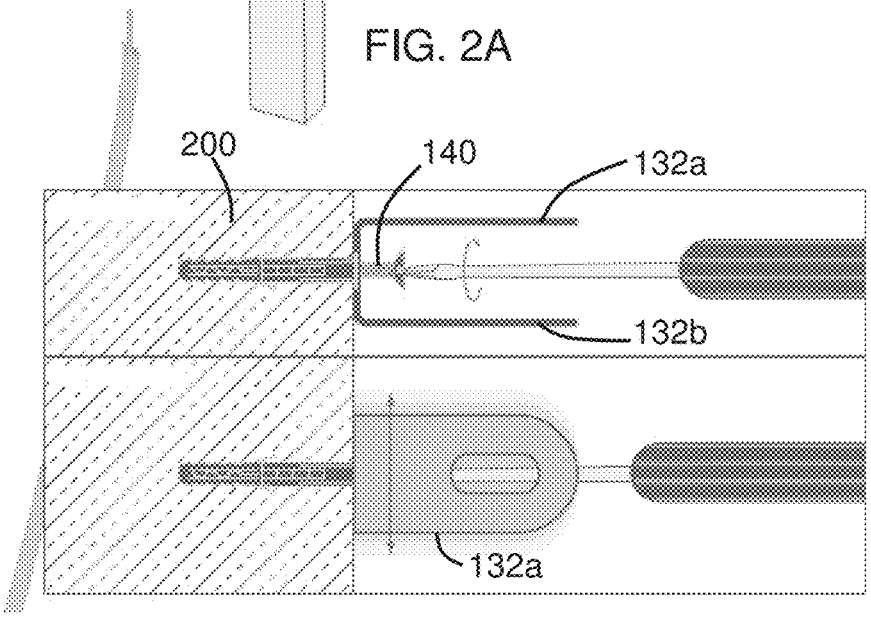

Turning now to FIG. 2A, the second component of the plurality of articulating fasteners 118 is a surface bracket 122*a-b*. The surface bracket 122*a-b* is the component that engages the mounting surface, which may include, without limitation, a wall, a ceiling, a pole, and a piece of furniture. The surface bracket 122*a-b* defines a substantially U-shaped cross-section that is configured to be hingedly coupled to the tightening element 120*a-b*. Similar to the projecting flanges of the tightening element 120*a-b*, the surface bracket 122*a-b* also has a pair of projecting flanges 132*a*, 132*b* that are configured for coupling to the tightening element 120*a-b* (See FIG. 2B). An orifice 134*a*, 134*b* forms in each of the pair of projecting flanges 132*a-b* of the surface bracket 122*a-b*.

To enable such pivotable articulations, the tightening element 120*a-b* may include at least one receptacle 128*a*, 128*b* that is sized and dimension to receive a hinge pin 130*a-b*. Each orifice 134*a-b* in each of the pair of projecting flanges 132*a-b* is configured for accepting the hinge pin 130*a-b* that extends into the receptacle in the tightening element 120*a-b*. The hinge pin 130*a-b* serves as a fulcrum to enable the tightening element 120*a-b* to pivot in relation to the surface bracket 122*a-b*.

Figure 5A:
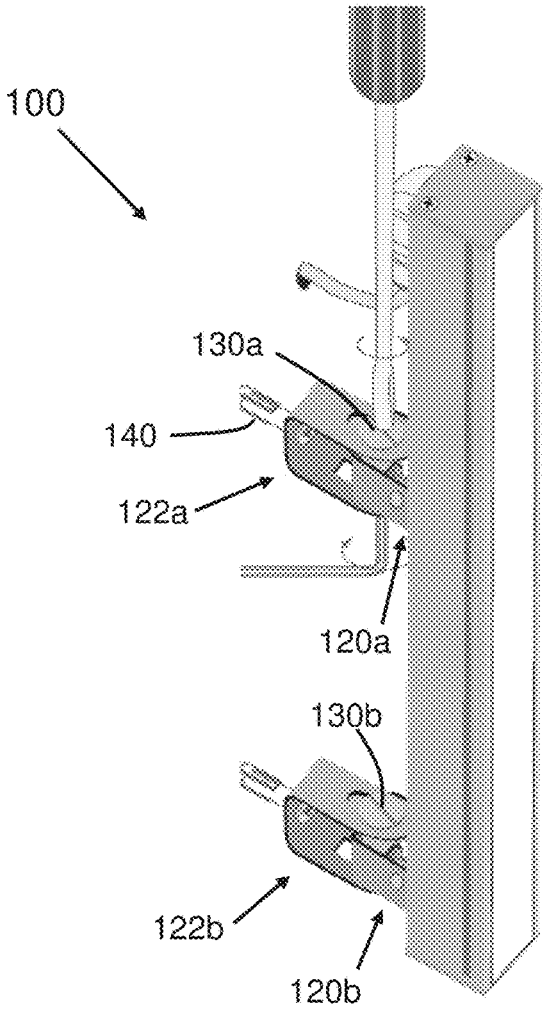
FIGS. 5A-5D show perspective views of the surface mounted LED-based linear lighting apparatus with articulating fastener during assembly, in accordance with one embodiment.
Figure 5B:
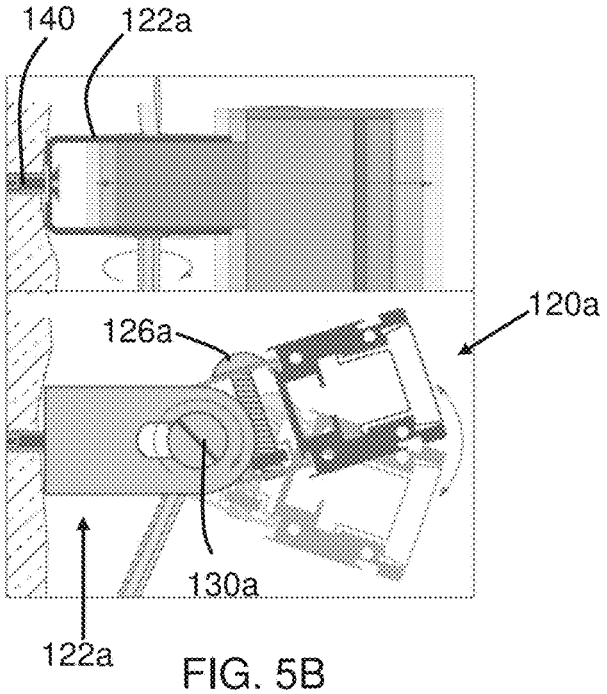
Figure 5C:
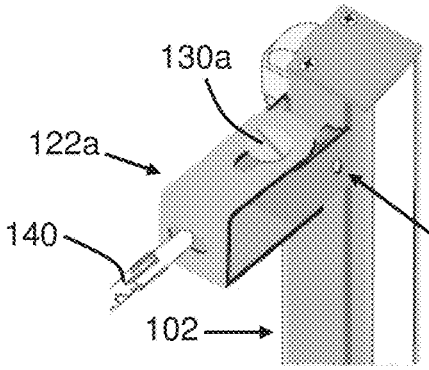
Figure 5D:
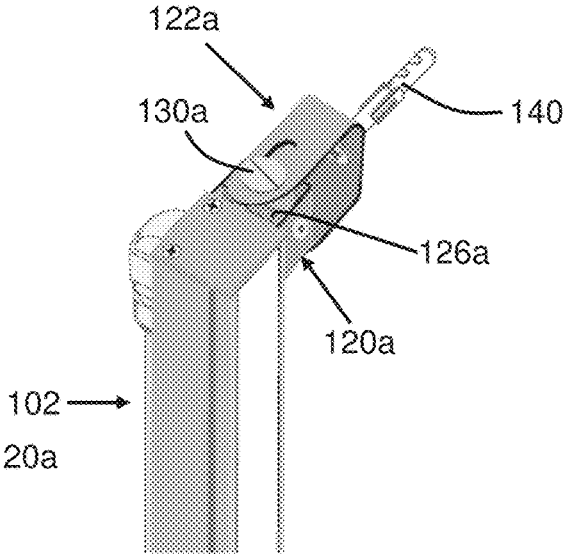

As shown in FIG. 5A, the hinge pin 130*a-b* comprises at least one bolt. In some embodiments, the hinge pin 130*a-b* may include, without limitation, a screw, a pin, a bolt, and an axle. However, in other embodiments, additional fastening mechanisms may be used in place of the bolt, such as a screw, a pin, a clip, a friction-fit mechanism, a weld, a magnet, or an adhesive. A screw driver or another tool may be used to rotatably tighten and loosen the hinge pin 130*a-b*.

The hinge pin 130*a-b* can be rotated to adjust the snugness between the projecting flanges in the surface bracket 122*a-b* and the receptacle in the tightening element 120*a-b*. This serves to regulate the tightness of the pivotal articulation. In any case, the hinge pin 130*a-b* extends through the orifice 134*a-b* into each of the pair of projecting flanges 132*a-b*, and into the at least one receptacle 128*a-b* in the tightening element 120*a-b*. Consequently, the extrusion 102, carrying the LED 106, also pivots with the tightening element 120*a-b* to a desired position of illumination.

Additionally, the surface bracket 122*a-b* has a mount wall 136*a*, 136*b* extending between the pair of projecting flanges. The mount wall 136*a-b* may form a mount hole 138 that enables passage of a mounting fastener 140, such as a screw, bolt, or a sleeve anchor bolt. In this manner, the surface bracket 122*a-b* fixedly mounts to the mounting surface 200. The tightening member fastens to the surface bracket 122*a-b* in a pivotal relationship, about the hinge pin 130*a-b*.

And the extrusion 102 detachably couples to the tightening member through the projecting flanges-grooves mating relationship. In this manner, the direction of illumination by the LED 106 in the extrusion 102 can be pivotally adjusted in the horizontal or the vertical, depending on the mounting orientation of the articulating fasteners 118.

In operation, an LED 106 is fitted into the channel 104 that forms in the extrusion 102. This may require coupling the metal connectors at the ends of the LED 106 to corresponding electrical connections at the top and bottom ends of the extrusion 102. Once fitted into the channel 104, the LED 106 is concentrically positioned between the first vertical sidewall 108, the second vertical sidewall 110, and the horizontal floor 112.

Figure 6A:
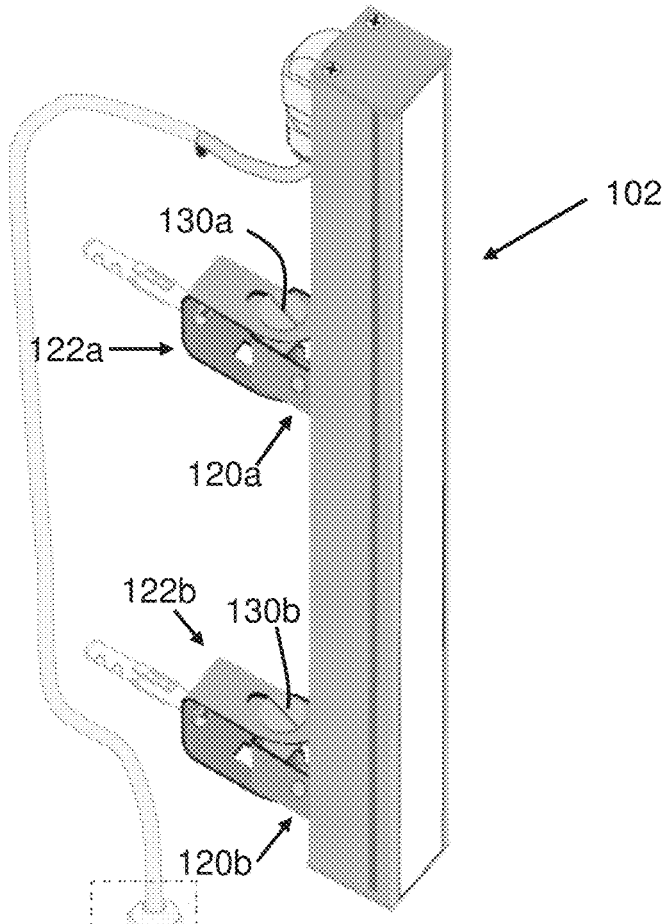
FIGS. 6A-6E show perspective views of the surface mounted LED-based linear lighting system with articulating fastener, in a fully assembled state, in accordance with one embodiment.
Figures 6B, 6C, 6D, 6E:
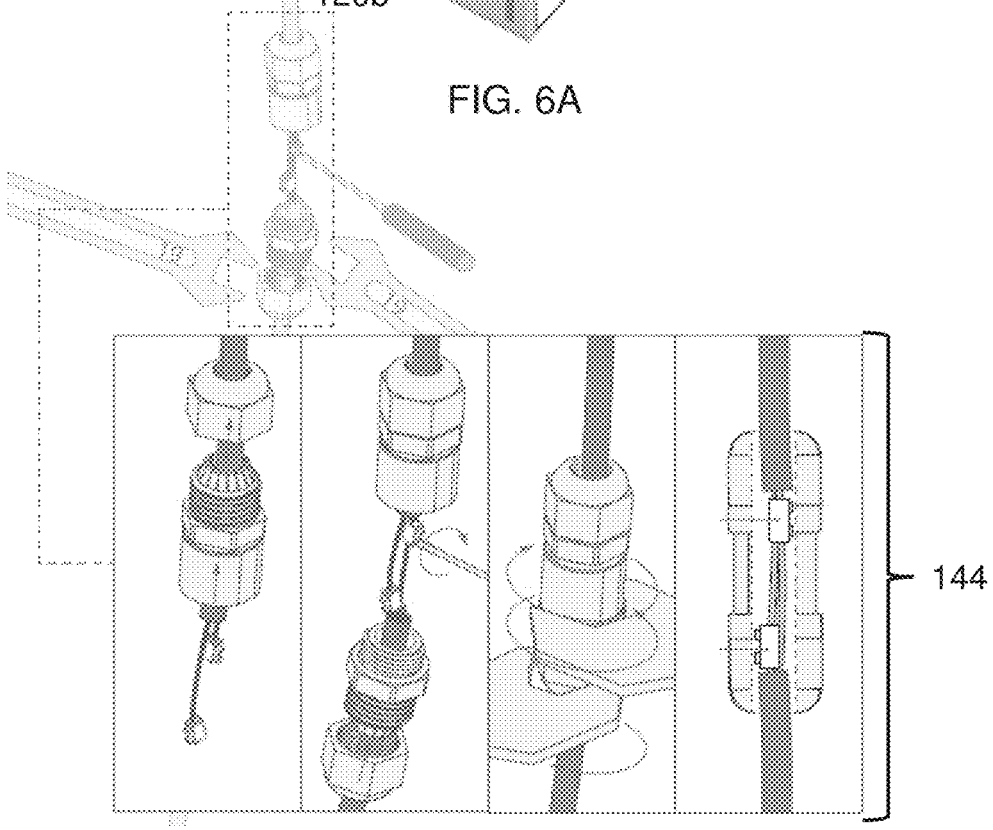

To enable electrical connectivity, an external power cord subassembly 144, shown in FIG. 6A couples to an electrical port in the exterior of the horizontal floor 112. The LED 106 may then be tested for operation by plugging the cord into a standard A/C power outlet. The light from the LED 106 reflects off the sidewalls 108, 110 and horizontal floor 112 of the extrusion 102 to illuminate in a single direction. FIG. 6B shows a pair of opposing wires being joined to produce electrical power. FIG. 6C shows individual wires being connected. FIG. 6D shows both ends being tightened by wrenches. And FIG. 6E shows the completely assembled external power cord subassembly 144.

Next, the articulating fasteners 118 are prepared for mounting to the mounting surface. Any number of articulating fasteners 118 may be used, depending on the dimensions of the extrusion 102. The articulating fastener, as described above, comprises a surface bracket 122*a-b* that mounts to the mounting surface 200, and a tightening member that couples to the extrusion 102.

First, the surface bracket 122*a-b* is oriented such that the mount wall faces the mounting surface at the desired point of mounting. A fastener 140, such as a sleeve anchor bolt, is then forcibly extended through the mount hole 138 until the articulating fastener securely affixed to the mounting surface. This may require utilizing a power drill, hammer, or other fastening means known in the art.

At this point, the hinge pin 130*a-b* should be introduced between the surface bracket 122*a-b* and the tightening means. This allows the tightening means to pivotally articulate up to 180°, touching both sides of the mounting surface. The hinge pin 130*a-b* can simply be a large screw that is rotatably inserted into the receptacle that forms in the tightening member, and the orifices that form in each of the pair of projecting flanges of the surface bracket 122*a-b*. The tightness of the hinge pin 130*a-b* can be adjusted to achieve the desired rate of pivotable articulation.

Next, the extrusion 102 is connected to the articulating fasteners 118 through the groove-flange connection (See FIG. 5A). This involves aligning the grooves with the projecting flanges of the tightening member, and sliding the projecting flanges along the grooves to the desired elevation of the extrusion 102 and LED 106 contained therein. Depending on the desired orientation of the illumination, any combination of projecting flanges and grooves may be coupled. For example, the second and third grooves 302, 304 serve as the connection points to position the articulating fastener directly behind the extrusion 102 at the horizontal floor 112 (FIG. 5B). This allows the extrusion 102 to pivot laterally from left to right, and thereby adjustably direct the direction of illumination.

In another embodiment shown in FIG. 5C, the second groove 302 of the horizontal floor 112 and the first groove 116 of the first sidewall are coupled together to position the articulating fastener to the right side of the extrusion 102, at the first vertical sidewall 108. This allows the extrusion 102 to pivot laterally about the first vertical sidewall 108, and thereby adjustably direct the direction of illumination. In yet another embodiment, the third groove 304 of the horizontal wall and the fourth groove 300 of the second sidewall serve as connection points to position the articulating fastener to the left side of the extrusion 102, at the second vertical sidewall 110 (FIG. 5D).

This allows the extrusion 102 to pivot laterally about the second vertical sidewall 110, and thereby adjustably direct the direction of illumination. Once the desired direction of illumination is set, the hinge pin 130*a-b* can be tightened to temporarily set the direction of the extrusion 102. FIGS. 6A-6E show the system 100 with extrusion and articulating fastener, in a fully assembled state mounted to the surface 200.

Figure 7:
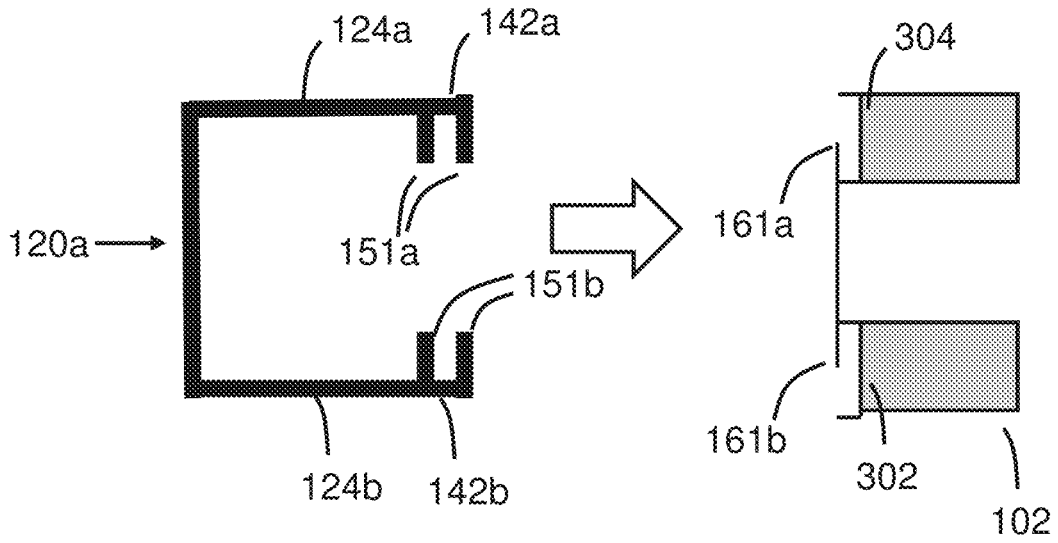
FIG. 7 shows the tightening element coupled to the extrusion, in accordance with one embodiment.

FIG. 7 shows that a tightening element 120*a* is the component that couples to the second and third grooves 302, 304 on the horizontal floor 112 of the extrusion 102. The tightening element 120*a* is defined by a substantially U-shaped cross-section. In one non-limiting embodiment, the tightening element 120*a* comprises a pair of projecting flanges 124*a*, 124*b* extend at an orthogonal from the U-shaped cross-section, forming free edges 142*a*, 142*b* at the termini. The position and configuration of the projecting flanges 124*a-b* enables facilitated, yet secure, coupling of the free edges 142*a-b* into the second and third grooves 302,

304 that form in the extrusion 102. In one embodiment, the free edges 142*a-b* of the projecting flanges 124*a-b* are slidably introduced into the grooves from the top end 114*a* of the extrusion 102. Once introduced into the groove, the projecting flanges 124*a-b* restrict disengagement of the tightening element 120*a-b* from the extrusion 102.

FIG. 7 shows the second and third grooves 302, 304 on the horizontal floor 112 of the extrusion 102. FIG. 7 also shows that groove 304 includes a flange 161*a* that extends in a plane parallel to the longitudinal axis of the extrusion and that extends partially over the groove 304. FIG. 7 further shows that groove 302 includes a flange 161*b* that extends in a plane parallel to the longitudinal axis of the extrusion and that extends partially over the groove 302. The purpose of flange 161*a* and 161*b* is to secure the tightening element 120*a* to the extrusion 102 once the free edges 142*a-b* of the projecting flanges 124*a-b* are slidably introduced into the grooves from the top end 114*a* of the extrusion 102.

FIG. 7 shows that the free edge 142*a* of the projecting flange 124*a* comprises a pair of projecting surfaces 151*a* with gap in between the pair of projecting surfaces, wherein the gap is configured to accept the flange 161*a*. FIG. 7 further shows that the free edge 142*b* of the projecting flange 124*b* comprises a pair of projecting surfaces 151*b* with gap in between the pair of projecting surfaces, wherein the gap is configured to accept the flange 161*b*. The purpose of flange 161*a* and 161*b* is to secure the tightening element 120*a* to the extrusion 102 such that the flanges prevent an outward force (in a direction perpendicular to the longitudinal axis of the extrusion 102) from removing the tightening element 120*a* to the extrusion 102.

Although specific claimed embodiments have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the invention.

I claim:

1. A surface-mounted linear lighting system comprising:

a metal extrusion comprising: a) an elongated element having a substantially U-shaped cross-section comprising a first vertical sidewall, a second vertical sidewall, and a horizontal floor joining the first and second sidewalls, b) a first groove on an exterior of from the first vertical sidewall, c) a second groove on an exterior of the horizontal floor, d) a third groove on the exterior of the horizontal floor, and e) a fourth groove on an exterior of the second vertical sidewall;

wherein the first groove is located at or near a top of the first vertical sidewall, wherein the fourth groove is located at or near a top of the second vertical sidewall, wherein the second groove is located at or near the first vertical sidewall and wherein the third groove is located at or near the second vertical sidewall;

a plurality of articulating fasteners configured for: a) coupling to a pair of grooves in the metal extrusion selected from the group consisting of: the first groove, the second groove, the third groove and the fourth groove, b) fastening to a surface, and c) providing a hinged connection between the metal extrusion and the surface;

wherein each of the plurality of articulating fasteners comprises:

a) a tightening element having a substantially U-shaped cross-section, wherein the tightening element is configured for coupling to a pair of grooves in the metal extrusion selected from the group consisting of: the first groove, the second groove, the third groove, and the fourth groove; and b) a surface bracket having a substantially U-shaped cross-section, wherein the surface bracket is configured for fastening to the surface, and hingedly coupling to the tightening element.

2. The surface-mounted linear lighting system of claim 1, wherein the tightening element further comprises a pair of projecting flanges configured for coupling to a pair of grooves in the metal extrusion selected from the group: the first groove, the second groove, the third groove and the fourth groove.

3. The surface-mounted linear lighting system of claim 2, wherein the tightening element further comprises a fastening screw configured for adjusting a distance between the pair of projecting flanges so as to adjust the coupling between the tightening element and the pair of grooves in the metal extrusion.

4. The surface-mounted linear lighting system of claim 3, wherein the tightening element further comprises at least one receptacle for a hinge pin.

5. The surface-mounted linear lighting system of claim 4, wherein the surface bracket further comprises a pair of projecting flanges configured for coupling to the tightening element.

6. The surface-mounted linear lighting system of claim 5, wherein the surface bracket further comprises an orifice located in each of the pair of projecting flanges, wherein each orifice in each of the pair of projecting flanges is configured for accepting the hinge pin that extends into the at least one receptacle in the tightening element.

7. The surface-mounted linear lighting system of claim 6, wherein the hinge pin comprises at least one bolt that extends through the orifice into each of the pair of projecting flanges and into the at least one receptacle in the tightening element.

8. A surface-mounted linear lighting system comprising:

a metal extrusion comprising: a) an elongated element having a substantially U-shaped cross-section comprising a first vertical sidewall, a second vertical sidewall, and a horizontal floor joining the first and second sidewalls, b) a first groove on an exterior of the first vertical sidewall, c) a second groove on an exterior of the horizontal floor, d) a third groove on the exterior of the horizontal floor, and e) a fourth groove on an exterior of the second vertical sidewall; and a plurality of articulating fasteners configured for providing a hinged connection between the metal extrusion and a surface, wherein each of the plurality of articulating fasteners comprises:

a) a tightening element having a substantially U-shaped cross-section, wherein the tightening element is configured for coupling to a pair of grooves in the metal extrusion selected from the group consisting of: the first groove, the second groove, the third groove and the fourth groove; and b) a surface bracket having a substantially U-shaped cross-section, wherein the surface bracket is configured for fastening to the surface, and hingedly coupling to the tightening element.

9. The surface-mounted linear lighting system of claim 8, wherein the first groove is located at or near a top of the first vertical sidewall and wherein the fourth groove is located at or near a top of the second vertical sidewall.

10. The surface-mounted linear lighting system of claim 9, wherein the second groove is located at or near the first vertical sidewall and wherein the third groove is located at or near the second vertical sidewall.

11. The surface-mounted linear lighting system of claim 10, wherein the tightening element further comprises a pair of projecting flanges configured for coupling to a pair of grooves in the metal extrusion selected from the group consisting of: the first groove, the second groove, the third groove and the fourth groove.

12. The surface-mounted linear lighting system of claim 11, wherein the tightening element further comprises a fastening screw configured for adjusting a distance between the pair of projecting flanges so as to adjust the coupling between the tightening element and the pair of grooves in the metal extrusion.

13. The surface-mounted linear lighting system of claim 12, wherein the tightening element further comprises at least one receptacle for a hinge pin.

14. The surface-mounted linear lighting system of claim 13, wherein the surface bracket further comprises a pair of projecting flanges configured for coupling to the tightening element.

15. The surface-mounted linear lighting system of claim 14, wherein the surface bracket further comprises an orifice located in each of the pair of projecting flanges, wherein each orifice in each of the pair of projecting flanges is configured for accepting the hinge pin that extends into the at least one receptacle in the tightening element.

16. The surface-mounted linear lighting system of claim 15, wherein the hinge pin comprises at least one bolt that extends through the orifice into each of the pair of projecting flanges and into the at least one receptacle in the tightening element.

17. A surface-mounted linear lighting system consisting of:

a metal extrusion comprising: a) an elongated element having a substantially U-shaped cross-section comprising a first vertical sidewall, a second vertical sidewall, and a horizontal floor joining the first and second sidewalls, b) a first groove on an exterior of the first vertical sidewall, c) a second groove on an exterior of the horizontal floor, d) a third groove on the exterior of the horizontal floor, and e) a fourth groove on an exterior of the second vertical sidewall; and a plurality of articulating fasteners configured for providing a hinged connection between the metal extrusion and a surface, wherein each of the plurality of articulating fasteners comprises:

a) a tightening element having a substantially U-shaped cross-section, wherein the tightening element is configured for coupling to a pair of grooves in the metal extrusion selected from the group: the first groove, the second groove, the third groove and the fourth groove, the tightening element comprising a pair of projecting flanges configured for coupling to a pair of grooves in the metal extrusion selected from the group consisting of: the first groove, the second groove, the third groove and the fourth groove; and b) a surface bracket having a substantially U-shaped cross-section, wherein the surface bracket is configured for fastening to the surface, and hingedly coupling to the tightening element, the surface bracket comprising a pair of projecting flanges configured for coupling to the tightening element, the surface bracket further defining an orifice located in each of the pair of projecting flanges.

* * * * *